US010987966B2

(12) United States Patent
Jones et al.

(10) Patent No.: US 10,987,966 B2
(45) Date of Patent: Apr. 27, 2021

(54) APPRECIATION CARD WITH HIDDEN GIFT CARD SLOT

(71) Applicant: The Hershey Company, Hershey, PA (US)

(72) Inventors: Graham Jones, Hershey, PA (US); Jill Scheneman, Hershey, PA (US); Linda A Bernstein, Lilburn, GA (US)

(73) Assignee: The Hershey Company, Hershey, PA (US)

( * ) Notice: Subject to any disclaimer, the term of this patent is extended or adjusted under 35 U.S.C. 154(b) by 63 days.

(21) Appl. No.: 16/212,636

(22) Filed: Dec. 6, 2018

(65) Prior Publication Data

US 2019/0168529 A1 Jun. 6, 2019

Related U.S. Application Data

(60) Provisional application No. 62/595,259, filed on Dec. 6, 2017.

(51) Int. Cl.

| | |
|---|---|
| ***B42D 15/00*** | (2006.01) |
| ***B42D 15/04*** | (2006.01) |
| ***B65D 5/66*** | (2006.01) |
| ***B42D 25/21*** | (2014.01) |
| ***B65D 5/50*** | (2006.01) |
| ***B65D 27/00*** | (2006.01) |
| *B42D 25/20* | (2014.01) |

(52) U.S. Cl.

CPC ..... *B42D 15/045* (2013.01); *B42D 25/21* (2014.10); *B65D 5/5007* (2013.01); *B65D 5/6608* (2013.01); *B65D 27/00* (2013.01); *B42D 25/285* (2014.10); *B42P 2241/02* (2013.01)

(58) Field of Classification Search

CPC ..... B65D 73/0085; B65D 73/0078; B65D 206/756; B65D 206/763; B42D 15/045; B42D 25/285

USPC ..... 206/756, 763, 783, 786, 487, 476

See application file for complete search history.

(56) References Cited

U.S. PATENT DOCUMENTS 1,555,566 A * 9/1925 Furste ..... G09F 1/08 40/124.06
2,387,639 A * 10/1945 Bouchelle ..... G09F 5/042 206/481
3,512,636 A * 5/1970 Davidson ..... B65D 73/0021 206/462
3,656,612 A * 4/1972 Sellors ..... B65D 5/4204 206/782
4,002,003 A * 1/1977 Place ..... B65B 15/02 53/415

(Continued)

*Primary Examiner* — Cassandra Davis
(74) *Attorney, Agent, or Firm* — Design IP

(57) ABSTRACT

An appreciation card including a front panel having a window formed therein that is located between the left side and the right side of the front panel and being defined by a window border. A gift card panel is disposed on the back face of the front panel below the window border. The gift card panel includes a pocket section and an attachment tab, the pocket section being connected to the window border on a first end and to the attachment tab at an opposing second end, the attachment tab being adhered to the back face of the front panel, and the pocket section being free from the back face of the front panel. The front panel and the gift card panel define a gift card slot into which a gift card may be inserted.

19 Claims, 5 Drawing Sheets

(56) References Cited

U.S. PATENT DOCUMENTS

| | | | | |
|---|---|---|---|---|
| 7,204,048 | B2 * | 4/2007 | Kershner | B42D 15/045 40/124.06 |
| 7,664,681 | B1 * | 2/2010 | Oliveau | G06Q 30/02 705/26.1 |
| 9,930,947 | B2 * | 4/2018 | Liguori | B42D 15/045 |
| 2003/0080013 | A1 * | 5/2003 | Smith | B65D 73/0078 206/449 |

* cited by examiner

APPRECIATION CARD WITH HIDDEN GIFT CARD SLOT

BACKGROUND

Appreciation cards are popular gifts to give friends, relatives, employees, and other individuals to whom a gift giver wants to show appreciation. Such appreciation cards are known to include gift cards which have a preset amount of currency associated therewith for use at one or more shopping establishments. In such circumstances, the appreciation card houses the gift card in such a way that it is unlikely to fall out of the appreciation card prior to delivery. Mechanisms by which an appreciation card houses a gift card include a plurality of corner pockets that house only the corners of the gift card, as well as obvious gift card pockets that are adhered to the surface of the appreciation card.

However, some purchasers of such appreciation cards either forget or decide not to include a gift card with the appreciation card. The absence of the gift card is obvious to the receiver of the appreciation card, which can engender a negative reaction by the receiver due to the belief that the sender is uncaring or cheap. In such circumstances, there is desire in the market to have an appreciation card that conceals the gift card receptacle or otherwise does not make obvious the absence of a gift card therein.

SUMMARY

In view of the foregoing background, an appreciation card is disclosed. The appreciation card includes a front panel having a front face, a back face opposite the front face, a left side edge located on one side, and a right side edge located on an opposite side. The front panel includes a window formed therein that is located between the left side edge and the right side edge and is defined by a window border. The appreciation card also includes a gift card panel disposed on the back face of the front panel below the window border. The gift card panel includes a pocket section and an attachment tab, the pocket section being connected to the window border on a first end and to the attachment tab at an opposing second end, the attachment tab being adhered to the back face of the front panel, and the pocket section being free from the back face of the front panel. The front panel and the gift card panel define a gift card slot located between the window border of the front panel and the first end of the gift card panel, the gift card slot being sized and shaped to enable a gift card to be inserted therein.

BRIEF DESCRIPTION OF THE DRAWINGS

For a more complete understanding of the present invention, reference is made to the following detailed description of an embodiment considered in conjunction with the accompanying drawings, in which.

DETAILED DESCRIPTION OF THE INVENTION

Figure 1:
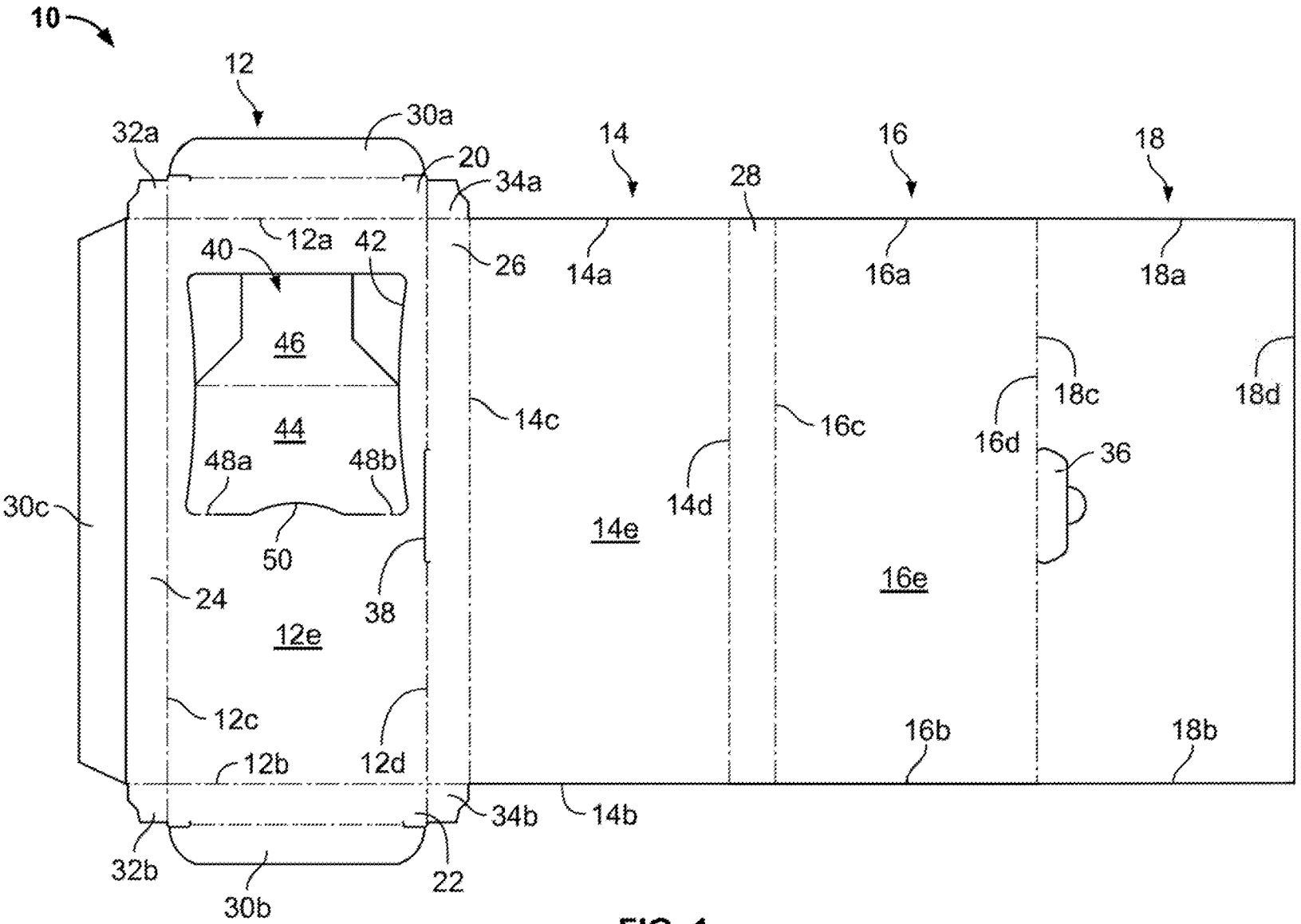
FIG. 1 is a top plan view of a card blank constructed in accordance with an embodiment of the present invention.

The following disclosure is presented to provide an illustration of the general principles of the present invention and is not meant to limit, in any way, the inventive concepts contained herein. Moreover, the particular features described in this section can be used in combination with the other described features in each of the multitude of possible permutations and combinations contained herein.

All terms defined herein should be afforded their broadest possible interpretation, including any implied meanings as dictated by a reading of the specification as well as any words that a person having skill in the art and/or a dictionary, treatise, or similar authority would assign particular meaning. Further, it should be noted that, as recited in the specification and in the claims appended hereto, the singular forms "a," "an," and "the" include the plural referents unless otherwise stated. Additionally, the terms "comprises" and "comprising" when used herein specify that certain features are present in that embodiment, but should not be interpreted to preclude the presence or addition of additional features, components, operations, and/or groups thereof.

The following disclosure is intended to be read in connection with the accompanying drawings, which are to be considered part of the entire written description of the invention. The drawing figures are not necessarily to scale and certain features of the invention may be shown exaggerated in scale or in somewhat schematic form in the interest of clarity and conciseness. In this description, relative terms such as "horizontal," "vertical," "up," "down," "top," "bottom," as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both moveable or rigid attachments or relationships, unless expressly described otherwise, and includes terms such as "directly" coupled, secured, etc. The term "operatively coupled" is such an attachment, coupling, or connection that allows the pertinent structures to operate as intended by virtue of that relationship.

Turning now to FIG. 1, a blank 10 constructed in accordance with an embodiment of the present invention is shown. The blank 10 is cut from a single sheet made from a stiff paper product, such as paperboard, and includes a plurality of panels that are sized and shaped to create an opening and closing card, including an inside front panel 12, a back panel 14, a front cover panel 16, and an inside cover panel 18. Each of the inside front, back, front cover, and inside front cover panels 12, 14, 16, 18 has an upper edge (i.e., upper edges 12*a*, 14*a*, 16*a*, 18*a*), a lower edge (i.e., lower edges 12*b*, 14*b*, 16*b*, 18*b*), a left side edge (i.e., left side edges 12*c*, 14*c*, 16*c*, 18*c*) and a right side edge (i.e., right side edges 12*d*, 14*d*, 16*d*, 18*d*). In one embodiment, the inside front panel 12, the back panel 14, the front cover panel 16, and the inside cover panel 18 are identically dimensioned, each having a length L, which corresponds to the length of the left and right side edges (i.e., left side edges 12*c*, 14*c*, 16*c*, 18*c* and right side edges 12*d*, 14*d*, 16*d*, 18*d*), and a width W, which corresponds to the length of the upper and lower edges (i.e., upper edges 12*a*, 14*a*, 16*a*, 18*a* and lower edges 12*b*, 14*b*, 16*b*, 18*b*). The solid lines shown in FIG. 1 indicate cut lines (i.e., locations where the blank 10 is cut), whereas the dash-dot lines, such as those corresponding to the left side edges 12*c*, 14*c*, 16*c*, and 18*c*, indicate fold lines (i.e., locations where the blank 10 is scored or pressed to facilitate folding).

In one embodiment, the blank 10 is sized and shaped to create a housing (see FIGS. 3-5) for a three-dimensional object, such as a candy bar (not shown), when constructed into an assembled appreciation card. Accordingly, the blank 10 is formed with a top side panel 20 extending from the upper edge 12*a* of the inside front panel 12, a bottom panel 22 extending from the lower edge 12*b* of the inside front panel 12, a left side panel 24 extending from the left side edge 12*c* of the inside front panel 12, and a right side panel 26 extending from the right side edge 12*d* of the inside front panel 12. The right side panel 26 is located between the right side edge 12*d* of the inside front panel 12 and the left side edge 14*c* of the back panel 14, and a left side cover panel 28 is positioned and extends between the right side edge 14*d* of the back panel 14 and the left side edge 16*c* of the front cover panel 16.

In one embodiment, each of the top side panel 20, the bottom side panel 22, the right side panel 26, and the left side cover panel 28 has a depth D that corresponds to the thickness of the housing of the assembled appreciation card, with the left side panel 24 having a depth that is slightly smaller than D to allow the left side panel 24 to be nested in the left side cover panel 28 when the blank 10 is constructed. To assist with construction and enclosing the housing of the assembled blank 10, the top side panel 20, the bottom side panel 22, and left side panel 24 include a top side tab 30*a*, a bottom side tap 30*b*, and a left side tab 30*c*, respectively, while the left side panel 24 and the right side panel 26 each include top and bottom flaps (i.e., top and bottom left side flaps 32*a*, 32*b* and top and bottom right side flaps 34*a*, 34*b*, respectively) that are located on either side of the top side and bottom side tabs 30*a*, 30*b*, respectively.

In one embodiment, a cover locking tab 36 is cut from the inside cover panel 18 and a cover locking tab slot 38 is cut along the right side edge 12*d* of the inside front panel 12. The cover locking tab 36 is sized and shaped to be inserted in the cover locking tab slot 38 when the blank 10 is assembled, as will be discussed in further detail below.

The blank 10 includes a gift card panel 40 that is cut from the inside front panel 12 along a window border 42. The gift card panel 40 includes a pocket section 44 and an attachment tab 46 whose function will be explained in detail further below. The gift card panel 40 is secured to the inside front panel 12 by a first flap hinge 48*a* and a second flap hinge 48*b*, which are uncut portions of the inside front panel 12 that enable the gift card panel 40 to remain attached to the inside front panel 12, thereby creating living hinges between the gift card panel 40 and the inside front panel 12. Between the first and second flap hinges 48*a*, 48*b* is a slit cut from the inside front panel 12 to create a gift card tab 50. In one embodiment, the gift card tab 50 has an arcuate shape that facilitates being pulled by a user's finger to reveal a gift card slot (not shown) into which a user can insert a gift card, as will be discussed in detail further below.

Figure 2:
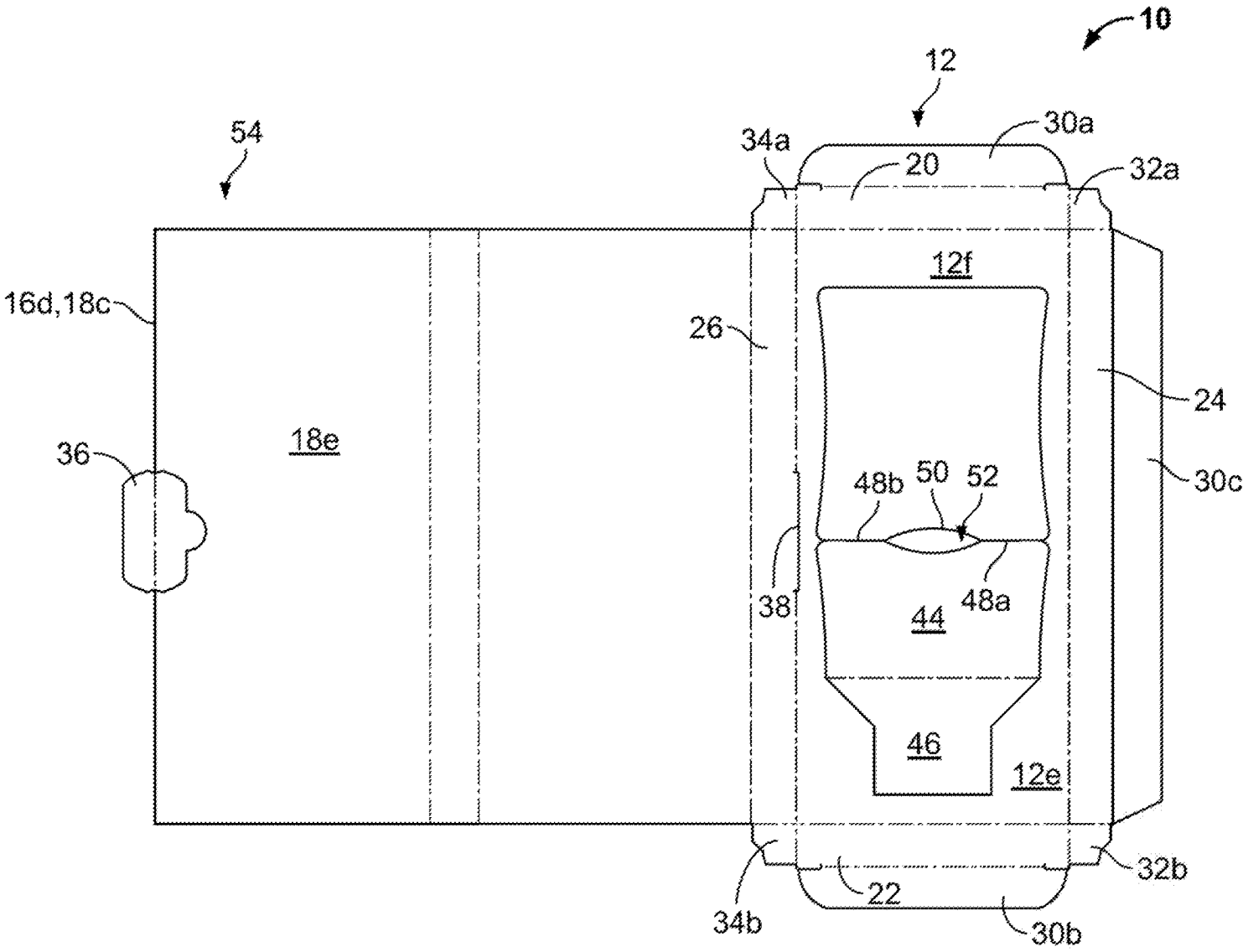
FIG. 2 is a bottom plan view of the card blank shown in FIG. 1 with the cut-out window folded against the back side of the inside front panel.

Turning now to FIG. 2, the gift card panel 40 is folded over its first and second flap hinges 48*a*, 48*b* toward the back face 12*f* of the inside front panel 12, creating a window 52 in the inside front panel 12 that is defined by the window border 42. Folding the gift card panel 40 over also creates a gift card slot 54 located between the gift card tab 50 and upper end of the pocket section 44. In one embodiment, the gift card slot 54 is located between the first and second flap hinges 48*a*, 48*b*.

The gift card slot 54 is sized and shaped to allow a gift card (not shown; see FIGS. 4 and 5) to be inserted therein, and the pocket section 44 and the attachment tab 46 of the gift card panel 40 are designed to create a pocket in which such a gift card may sit. Accordingly, the attachment tab 46 is adhered to the back face 12*f* of the inside front panel 12 while the pocket section 44 remains unattached to (i.e., free from) the back face 12*f* of the inside front panel 12. This allows the gift card to sit upon the edge of the attachment tab 46 and between the back face 12*f* of the inside front panel 12 and the pocket section 44 of the gift card panel 40. In one embodiment, the pocket section 44 of the gift card panel 40 is sized and shaped to have a length that is shorter than the length of the gift card to enable a portion of the gift card to be exposed above the window border 42.

The inside cover panel 18 is folded toward the front cover panel 16 along the left side edge 18*c* of the inside cover panel 18 (which is also the right side edge 16*d* of the front cover panel 16) such that the back faces 16*f*, 18*f* of the front and inside cover panels 16, 18 meet, thereby causing the cover locking tab 36 to pop out of the inside cover panel 18. The back face 18*f* of the inside cover panel 18 is adhered to the back face 16*f* of the front cover panel 16, creating a cover panel 56.

Figure 3:
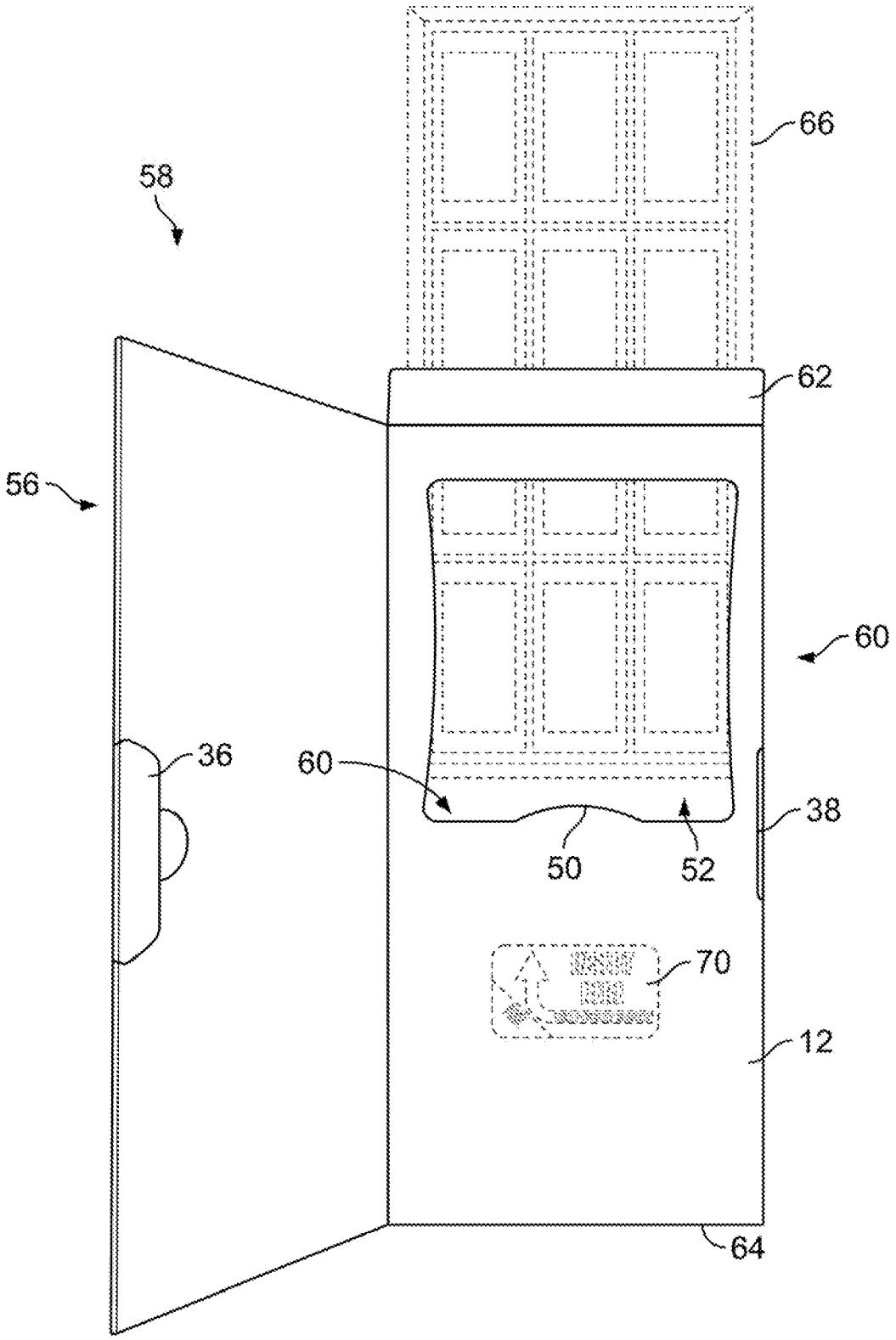
FIG. 3 is a top plan view of an assembled appreciation card constructed from the card blank shown in FIG. 1, the housing of the appreciation card having an open top end to enable entry of a candy bar.

Referring now to FIG. 3, the blank 10 is shown in an assembled state, which forms an appreciation card 58. The inside front panel 12 is folded in the direction of its back face 12*f* toward the back face 14*f* of the back panel 14 and positioned such that the inside front panel 12 and the back panel 14 are positioned parallel to each other, their back faces 12*f*, 14*f* are positioned a distance D away from each other, and their upper edges 12*a*, 14*a* and their lower edges 12*b*, 14*b* are aligned, respectively. This positions the right side panel 26 to be substantially perpendicular to the inside front panel 12 and the back panel 14. The left side panel 24 is folded over the left side edge 12*c* of the inside front panel 12 to be substantially parallel to the right side panel 26, and the left side tab 30*c* is adhered to the back face 14*f* of the back panel 14. This creates a gift housing 60 in which a three-dimensional object, such as a candy bar 66, can be inserted as a gift to the recipient of the appreciation card 58. Once the candy bar 66 is inserted, the top side panel 20, the top side tab 30*a*, and the top left and top right side flaps 32*a*, 34*a* cooperate to enclose the top side 62 of the appreciation card 58 in a manner well known in the art. Likewise, the bottom side panel 22, the bottom side tab 30*b*, and the bottom left and bottom right side flaps 32*b*, 34*b* cooperate to enclose the bottom side 64 of the appreciation card 58. The candy bar 66 can then be seen inside the gift housing 60 via the window 52.

Figure 4:
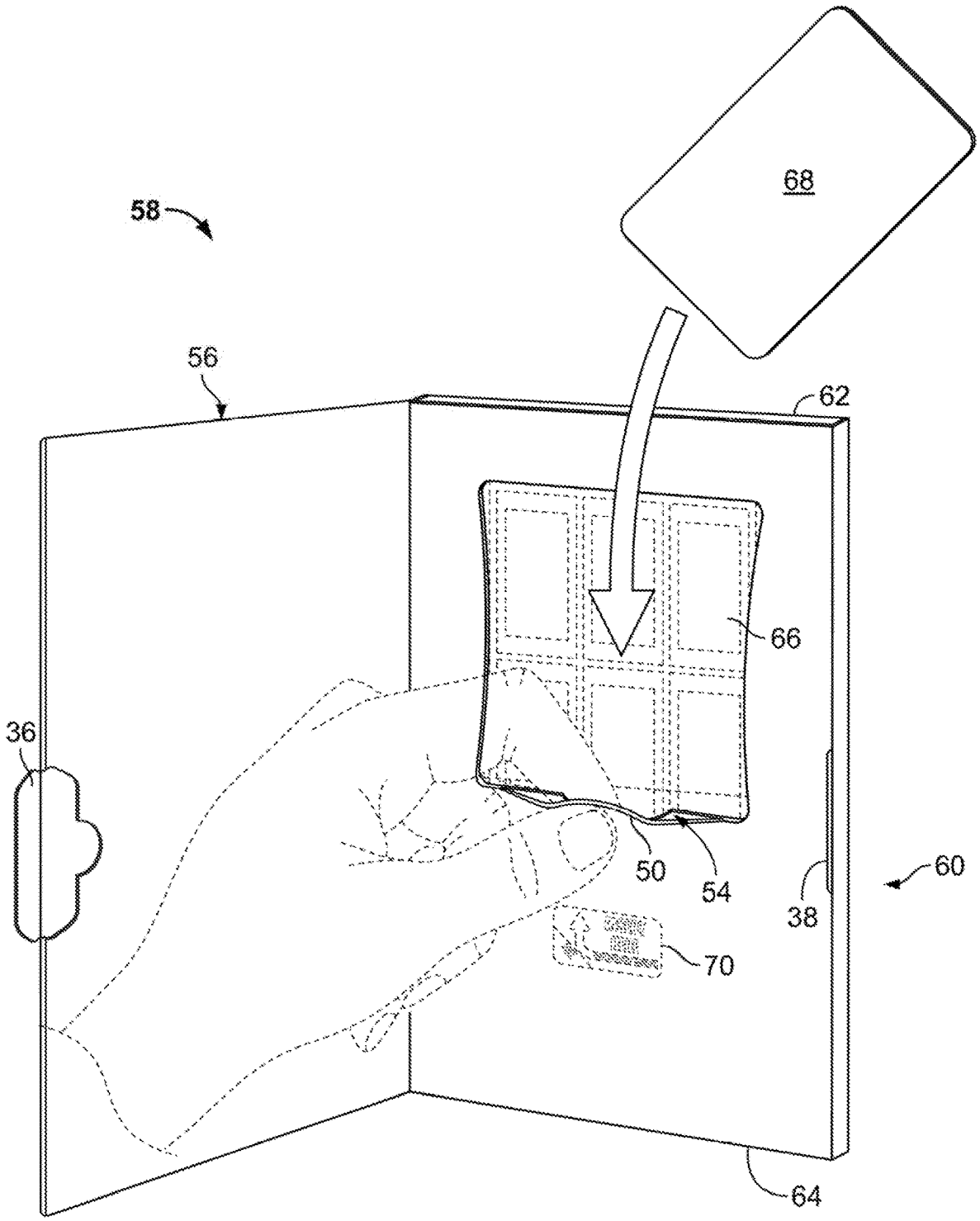
FIG. 4 is a perspective view of the appreciation card shown in FIG. 3 illustrating how a gift card is inserted in the gift card slot of the appreciation card.
Figure 5:
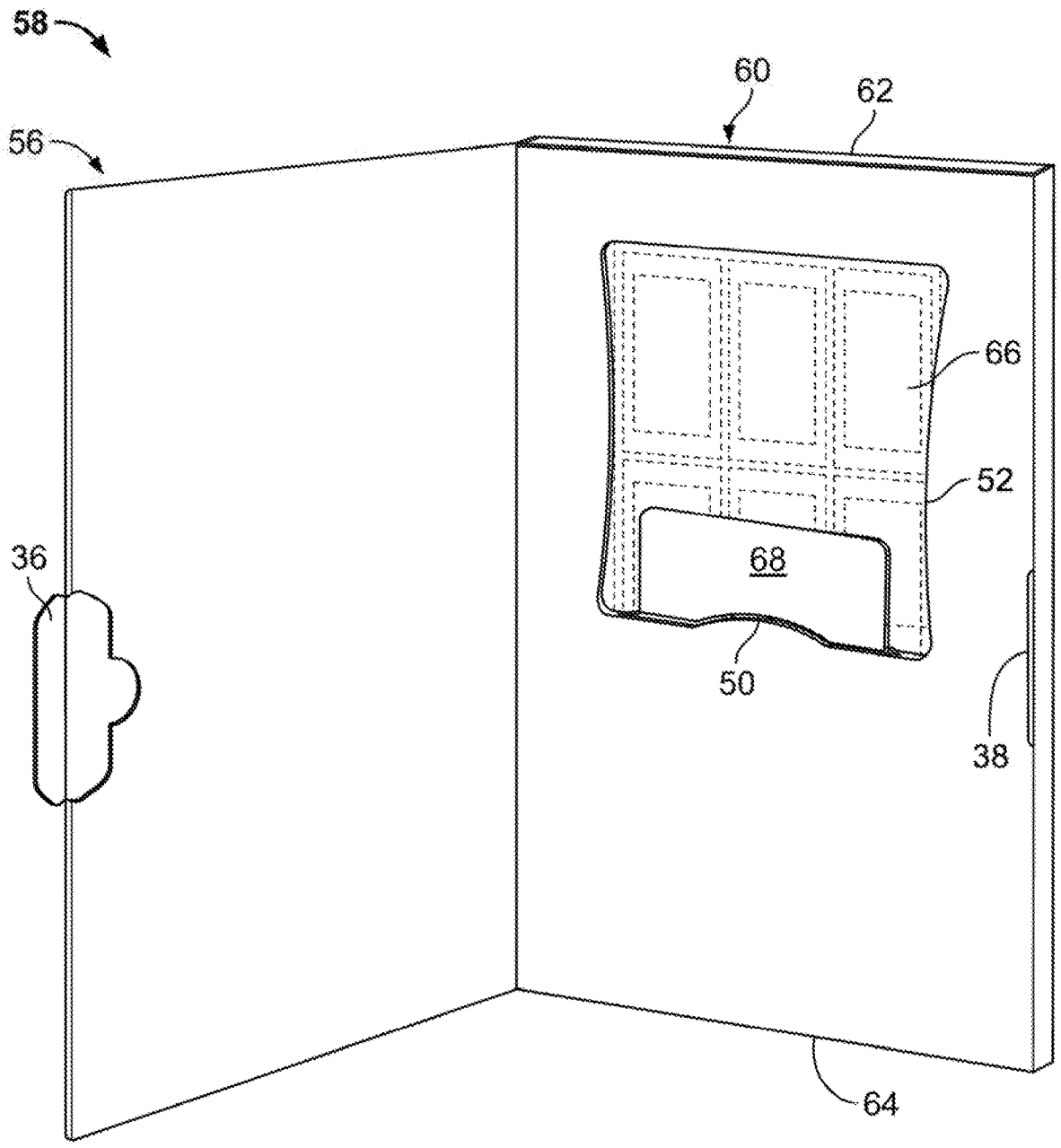
FIG. 5 is the view of FIG. 4 with the gift card inserted into the gift card slot.

Referring now to FIGS. 4 and 5, once the appreciation card 58 has been constructed and the candy bar 66 has been inserted therein, a gift card 68 may be inserted into the gift card slot 54 of the appreciation card 58. At the outset, with the appreciation card 58 constructed, the gift card slot 54 is sandwiched between the gift card tab 50 and the candy bar 66. This conceals the gift card slot 54 from view when looking at the inside front panel 12 of the appreciation card, as seen in FIG. 3. To access the gift card slot 54, a user first slips his/her finger behind the gift card tab 50 and pulls it away from the candy bar 66, thereby revealing the gift card slot 54. Thereafter, the user may insert a gift card 68 into the gift card slot 54 and push the gift card 68 downwardly until its edge reaches the lower end of the pocket section 44 of the gift card panel 40. The gift card 68 is then sitting in the pocket created by the gift card slot 54, the first and second flap hinges 48*a*, 48*b*, and the pocket section 44 and the attachment tab 46 of the gift card panel 40. From here, the cover panel 56 is folded over the inside front panel 12 and the cover locking tab 36 may be inserted into the cover locking tab slot 38, making a book-like appreciation card 58 that can be delivered to a recipient.

There are many advantages to this embodiment of an appreciation card 58. First, the structure of the pocket created by the gift card panel 40 and the gift card slot 54 allows a gift card 68 inserted therein to be better maintained inside the appreciation card 58 in the event that the appreciation card gets jostled. Second, because pocket of the appreciation card 58 holds the gift card 68 around its middle and not at its corners, the gift card 68 is less likely to break due to stress from bending the gift card 68, as could happen when inserting and removing a gift card 68 from a corner pocket arrangement.

Third, the concealment of the gift card slot 54 between the gift card tab 50 and the candy bar 66 allows the insertion of a gift card to be optional for the giver of the appreciation card 58. Because it is not immediately apparent to a receiver of the appreciation card 58 that a gift card 68 is supposed to be inserted into the gift card slot 54, it allows the giver of the appreciation card 58, who may have either forgotten or deliberately chose not to insert a gift card 68 into the gift card slot 54 prior to delivering the appreciation card 58 to the recipient, to not appear as thoughtless or unappreciative to the recipient.

Many variations of the above described embodiment can be made without departing from the scope of the present invention. For instance, the appreciation card 58 can include a removable instruction label 70 that informs the user/giver that a gift card 68 may be inserted in the gift card slot 54 behind the gift card tab 50. By being removable, this allows the giver who decides not to include a gift card 68 with the appreciation card 58 to remove the instruction label 70 from the appreciation card 58, thereby hiding from the recipient the fact that the appreciation card 58 could have included a gift card 68 which the giver ultimately decided not to include.

In addition, the appreciation card need not include a gift housing 60. In such circumstances, the blank 10 would not be cut to include the top, bottom, left, and right side panels 20, 22, 24, 26, the left side cover panel 28, and any of the tabs and flaps attached thereto (i.e., top, bottom, left and right side tabs 30*a-d*; top and bottom left side flaps 32*a-b* and top and bottom right side flaps 34*a-b*), and the back face 14*f* of the back panel 14 could simply be adhered to the back face 12*f* of the inside front panel 12 after the gift card panel 40 had been adhered to the inside front panel 12 as described above.

All examples and conditional language recited herein are intended for pedagogical purposes to aid the reader in understanding the principles of the present invention and the concepts contributed by the inventor in furthering the art. As such, they are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

It is to be understood that the embodiments described herein are merely exemplary and that a person skilled in the art may make many variations and modifications without departing from the spirit and scope of the invention. All such variations and modifications are intended to be included within the scope of the invention, as defined by the following claims.

What is claimed:

1. An appreciation card comprising:

a front panel having a front face and a back face opposite the front face, the front panel including a window defined by a window border; and a gift card panel disposed on the back face of the front panel below the window border, the gift card panel including a first end connected to the window border, a second end opposite the first end that is attached to the back face of the front panel, and a middle section extending between the first end and the second end that is free from the back face of the front panel.

2. The appreciation card of claim 1, wherein the front panel and the gift card panel define a gift card slot located between the window border of the front panel and the first end of the gift card panel, the gift card slot being sized and shaped to enable a gift card to be inserted therethrough.

3. The appreciation card of claim 2, wherein the window border defines a gift card tab formed in the front panel and located proximate to the gift card slot.

4. The appreciation card of claim 3, wherein the gift card slot is positioned behind the gift card tab such that the gift card slot is concealed from view by the gift card tab when viewing the front face of the front panel.

5. The appreciation card of claim 3, wherein the gift card tab has an arcuate shape.

6. The appreciation card of claim 2, wherein the first end of the gift card panel is connected to the window border of the front panel by a first hinge and a second hinge and the gift card slot is positioned between the first hinge and the second hinge.

7. The appreciation card of claim 2, wherein the front face of the front panel includes a removable label having instructions for inserting a gift card into the gift card slot.

8. The appreciation card of claim 1, further comprising a gift housing positioned behind the front panel proximate to the gift card panel, the housing being sized and shaped to house a three-dimensional object.

9. The appreciation card of claim 8, wherein the three-dimensional object is a candy bar.

10. The appreciation card of claim 8, further comprising a back panel, a left side panel and a right side panel, the left side panel being attached to the front panel on a first side and the back panel on a first side, and the right side panel being attached to the front panel on an opposing second side and the back panel on an opposing second side, wherein the housing is defined by the front panel, the back panel, the left side panel and the right side panel.

11. A method of manufacturing an appreciation card, the method comprising:

cutting a card blank including at least one panel having a front face and a back face opposite the front face;

cutting a gift card panel from the at least one panel of the card blank, the gift card panel including a first end and a second end, the first end being attached to the at least one panel;

folding the gift card panel toward the back face of the at least one panel; and adhering the second end of the gift card panel to the back face of the at least one panel.

12. The method of claim 11, wherein cutting the gift card panel includes creating a first hinge and a second hinge that connect the first end of the gift card panel to the at least one panel.

13. The method of claim 12, further comprising cutting a gift card slit between the at least one panel and the first end of the gift card panel, the gift card slit extending from the first hinge to the second hinge.

14. The method of claim 13, wherein cutting the gift card slit includes cutting a gift card tab in between the first hinge and the second hinge.

15. The method of claim 14, wherein cutting the gift card slit includes cutting a gift card tab such that when the gift card panel is folded toward the back face of the at least one panel, the gift card slot is positioned behind the gift card tab.

16. The method of claim 15, wherein the gift card tab has an arcuate shape.

17. The method of claim 11, further comprising applying a removable label to the front face of the at least one panel, the removable label having instructions for inserting a gift card into the gift card slot.

18. The method of claim 11, wherein the at least one panel includes a plurality of connected panels.

19. An appreciation card comprising:

a front panel having a front face, a back face opposite the front face, a left side edge located on one side, and a right side edge located on an opposite side, the front panel including a window formed therein that is located between the left side edge and the right side edge, the window being defined by a window border; and a gift card panel disposed on the back face of the front panel below the window border, the gift card panel including a pocket section and an attachment tab, the pocket section being connected to the window border on a first end and to the attachment tab at an opposing second end, the attachment tab being adhered to the back face of the front panel, and the pocket section being free from the back face of the front panel;

wherein the front panel and the gift card panel define a gift card slot located between the window border of the front panel and the first end of the gift card panel, the gift card slot being sized and shaped to enable a gift card to be inserted therein.

* * * * *